US011212603B2

(12) United States Patent
Waldon et al.

(10) Patent No.: US 11,212,603 B2
(45) Date of Patent: Dec. 28, 2021

(54) POLYMORPHIC LOUDSPEAKER

(71) Applicant: MS ELECTRONICS LLC, Lenexa, KS (US)

(72) Inventors: Laura LeAnn Waldon, Kansas City, MO (US); Timothy Richard Hoffman, Belton, MO (US); Loren Paul Magruder, Stilwell, KS (US)

(73) Assignee: MS Electronics LLC, Lenexa, KS (US)

( * ) Notice: Subject to any disclaimer, the term of this patent is extended or adjusted under 35 U.S.C. 154(b) by 0 days.

(21) Appl. No.: 17/061,648

(22) Filed: Oct. 2, 2020

(65) Prior Publication Data

US 2021/0112321 A1 Apr. 15, 2021

Related U.S. Application Data

(60) Provisional application No. 62/914,783, filed on Oct. 14, 2019.

(51) Int. Cl.
*H04R 1/02* (2006.01)

(52) U.S. Cl.
CPC ..... *H04R 1/025* (2013.01); *H04R 1/021* (2013.01); *H04R 1/026* (2013.01); *H04R 2201/021* (2013.01); *H04R 2201/028* (2013.01); *H04R 2400/11* (2013.01)

(58) Field of Classification Search
CPC .. H04R 1/025; H04R 1/026; H04R 2201/021; H04R 2400/11; H04R 1/021; H04R 2201/028
See application file for complete search history.

(56) References Cited

U.S. PATENT DOCUMENTS

2021/0074314 A1* 3/2021 Kristjansson ..... G10L 25/57
2021/0219036 A1* 7/2021 Hanna ..... B05B 1/185
2021/0219047 A1* 7/2021 Johnson ..... H04R 1/025

* cited by examiner

*Primary Examiner* — Andrew L Sniezek
(74) *Attorney, Agent, or Firm* — Hovey Williams LLP

(57) ABSTRACT

A speaker assembly broadly comprises an inner housing, an outer shell, an input circuit, and a speaker. The inner housing includes outer shell attachment structure and a lower press-fit outer surface and forms a central chamber retaining the input circuit and the speaker. The outer shell includes a primary enclosure and a lower cap. The primary enclosure includes inner housing attachment structure configured to align with and engage the outer shell attachment structure. The primary enclosure is configured to be press-fit to the inner housing via the lower press-fit outer surface of the inner housing. The lower cap encloses a bottom end of the central chamber. The outer shell is interchangeable with other outer shells having different shapes than the outer shell of the speaker assembly.

18 Claims, 6 Drawing Sheets

POLYMORPHIC LOUDSPEAKER

RELATED APPLICATION

This application is a regular utility non-provisional application and claims priority benefit of U.S. Provisional Patent Application Ser. No. 62/914,783 entitled "POLYMORPHIC LOUDSPEAKER", filed Oct. 14, 2019. The above-referenced provisional application is hereby incorporated by reference in its entirety.

BACKGROUND

Speakers come in different shapes depending on the desired visual aesthetics of a listening area in which the speakers are to be mounted. For example, decorative speakers may have housings that look like light fixtures or ornaments. Other speakers have more functional or inconspicuous housings. Speakers have internal electronic components that are arranged and mounted in their housings differently depending on the housing's shape, which results in increased design complexity and inconsistent sound quality. Furthermore, if different speaker shapes are desired, the speakers must be replaced with entirely new speakers.

SUMMARY

Embodiments of the invention solve the above-mentioned problems and provide a distinct advance in the art of speaker housings. More particularly, the invention provides a speaker assembly that can take one of several external shapes.

An embodiment of the invention is a speaker assembly broadly comprising an inner housing, an outer shell, a hanging assembly, a speaker, and an input circuit. The outer shell is interchangeable with, and can be selected from, a number of outer shells having different shapes.

The inner housing includes bracket attachment structure, a lower press-fit surface, outer shell attachment structure, and a speaker groove. The inner housing has a universal shape that is compatible with the interchangeable outer shells.

The bracket attachment structure includes two bolt holes offset on either side of the cord opening for securing the inner housing to the hanging assembly. Alternatively, screw holes, pin holes, or other features for securing the inner housing to a bracket of the hanging assembly may be used.

The lower press-fit surface frictionally engages the outer shell to secure the outer shell on the inner housing. To that end, the lower press-fit surface may be the outer-most surface of the inner housing.

The outer shell attachment structure includes a number of countersunk holes on a top side of the inner housing. The outer shell attachment structure aligns the outer shell with the inner housing in addition to facilitating attachment therebetween.

The speaker groove retains the speaker near a bottom of the inner housing. The speaker groove is a downward-facing annular recess such that the speaker faces downward at the bottom of a central chamber of the inner housing.

The outer shell encloses the inner housing and includes a primary enclosure, an upper section, and a lower cap. The outer shell is cylindrical and is interchangeable with outer shells that are spherical, conical, frustoconical, bulbous, bell-shaped, flared, or any other suitable shape.

The primary enclosure at least partially encloses the inner housing and includes inner housing attachment structure, upper section attachment structure, rib grooves, and a lower cap groove. The primary enclosure is cylindrical but may be interchangeable as mentioned above.

The inner housing attachment structure is a set of mounting bosses for attaching the outer shell to the inner housing. To that end, the mounting bosses align with the outer shell attachment structure of the inner housing. The upper section attachment structure is a set of fastener holes for attaching the upper section attachment structure to the primary enclosure.

The rib grooves align with ribs of the upper section. The rib grooves may be annularly spaced-apart vertical slots configured to annularly align the ribs (and hence the upper section) with the primary enclosure.

The lower cap groove is an annular recess configured to receive an outer edge of the lower cap. The lower cap groove may be configured such that the lower cap is press-fit to a bottom of the primary enclosure.

The upper section at least partially encircles the primary enclosure and may include primary enclosure attachment structure and a number of ribs. The upper section may enhance acoustic quality of soundwaves generated by the speaker and may improve aesthetics of the speaker assembly.

The primary enclosure attachment structure includes a set of fastener holes configured to receive fasteners therethrough. The primary enclosure attachment structure align with the upper section attachment structure of the primary enclosure.

The ribs extend vertically downward and are configured to be aligned with the rib grooves of the primary enclosure. The ribs provide radial rigidity to the upper section and annularly align the upper section with the primary enclosure via the rib grooves.

At least a portion of the upper section is radially spaced from the primary enclosure to create an acoustic channel. The acoustic channel may enhance acoustic quality of soundwaves generated by the speaker.

The lower cap encloses the central chamber of the inner housing at a bottom end of the inner housing and may include a number of sound openings. The lower cap may be press-fit to the primary enclosure of the outer shell via the lower cap groove.

The hanging assembly secures the speaker assembly to a ceiling, a structural beam, a wall mount, a shelf, or any other suitable elevated structure. The hanging assembly may include supports, a bracket, and/or other components for supporting the weight of the speaker assembly.

The speaker generates soundwaves and may be mounted to a bottom of the inner housing. The speaker faces downward for projecting the soundwaves through the sound openings. The input circuit receives audio signals from an external sound system and actively or passively sends the audio signals to the speaker.

The above-described speaker assembly provides several advantages. For example, the outer shell can be interchanged with other outer shells having different shapes. In this way, it is not necessary to create internal assembly structure for the speaker and input circuit for different external visual aesthetics (and acoustic quality). Similarly, new outer shells can be designed without having to also design internal assembly structure. Instead, the outer shells just need to be compatible with the inner housing.

The outer shell may be press-fit with the inner housing via the lower press-fit surface of the inner housing. The outer shell attachment structure and the inner housing attachment structure further secure the outer shell to the inner housing and annularly aligns the outer shell and the inner housing.

The upper section of the outer shell may also improve acoustic quality of the soundwaves generated by the speaker. To that end, the acoustic channel between the upper section and the primary enclosure of the outer shell may help focus or direct the soundwaves to a desired listening area.

Another embodiment is a speaker assembly broadly comprising an inner housing, an outer shell, a hanging assembly, a speaker, and an input circuit. These components are similar to the components described above except for the outer shell, and thus only the outer shell will be summarized below.

The outer shell has a concave tapered cylinder shape and includes a primary enclosure and a lower cap. The outer shell is interchangeable with the outer shells described above.

The primary enclosure at least partially encloses the inner housing and includes inner housing attachment structure and a lower cap groove. The primary enclosure may provide a different aesthetic and different acoustic properties than the primary enclosure of the first embodiment.

The inner housing attachment structure is a set of mounting bosses for attaching the outer shell to the inner housing. To that end, the mounting bosses align with the outer shell attachment structure of the inner housing. The upper section attachment structure is a set of fastener holes for attaching the upper section attachment structure to the primary enclosure.

The lower cap groove is an annular recess configured to receive an outer edge of the lower cap. The lower cap groove may be configured such that the lower cap may be press-fit/interference fit to a bottom of the primary enclosure.

The lower cap encloses the central chamber at a bottom end of the inner housing and may include a plurality of sound openings. The lower cap may be press-fit/interference fit to the primary enclosure of the outer shell via the lower cap groove.

The plurality of sound openings allow soundwaves generated by the speaker to pass out of the central chamber. The plurality of sound openings may be a set of small through-holes or slots. Alternatively, a single sound opening may be used. The plurality of sound openings may also allow moisture to escape the central chamber.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
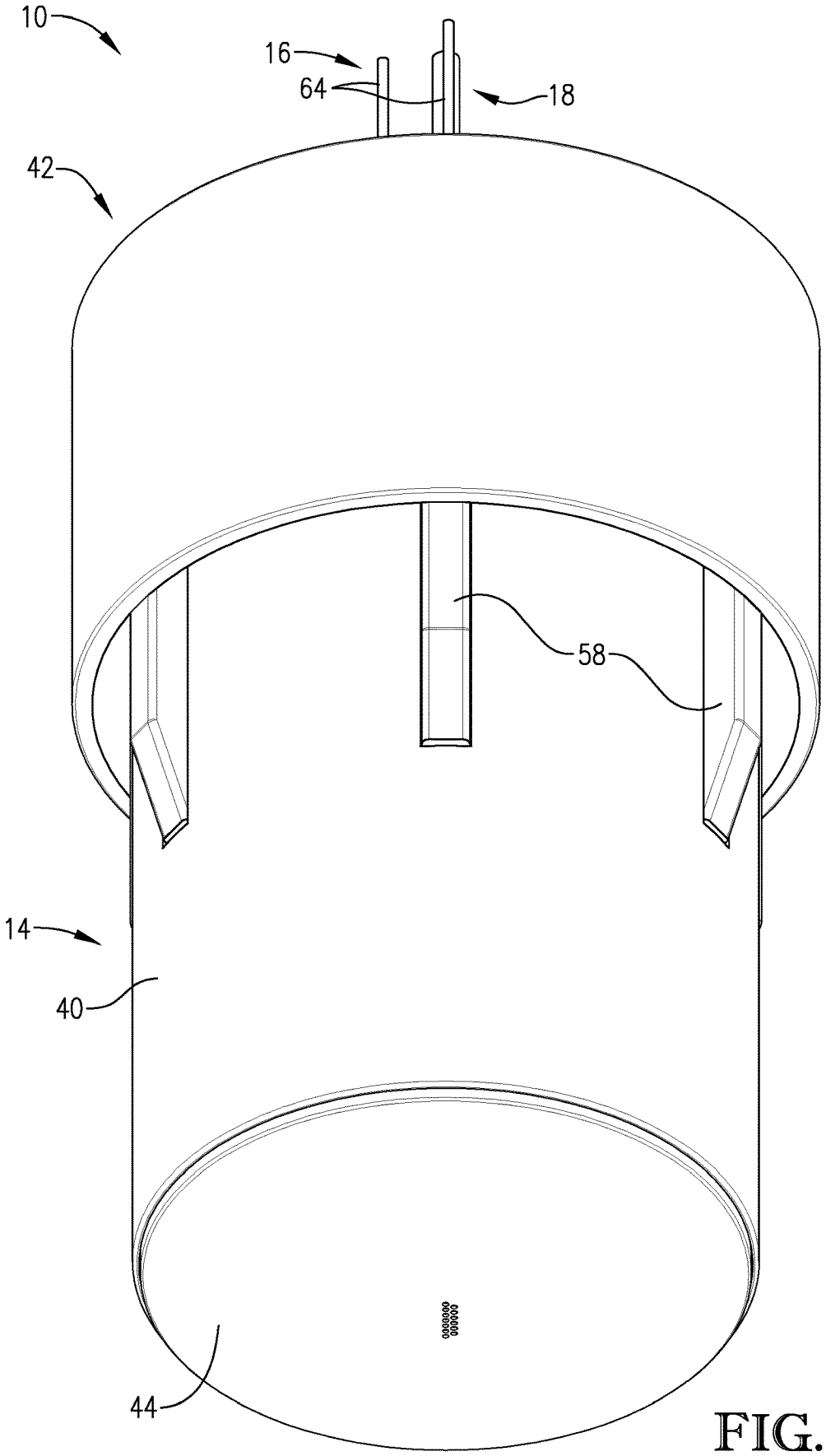
FIG. 1 is a bottom perspective view of a speaker assembly constructed in accordance with an embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 2:
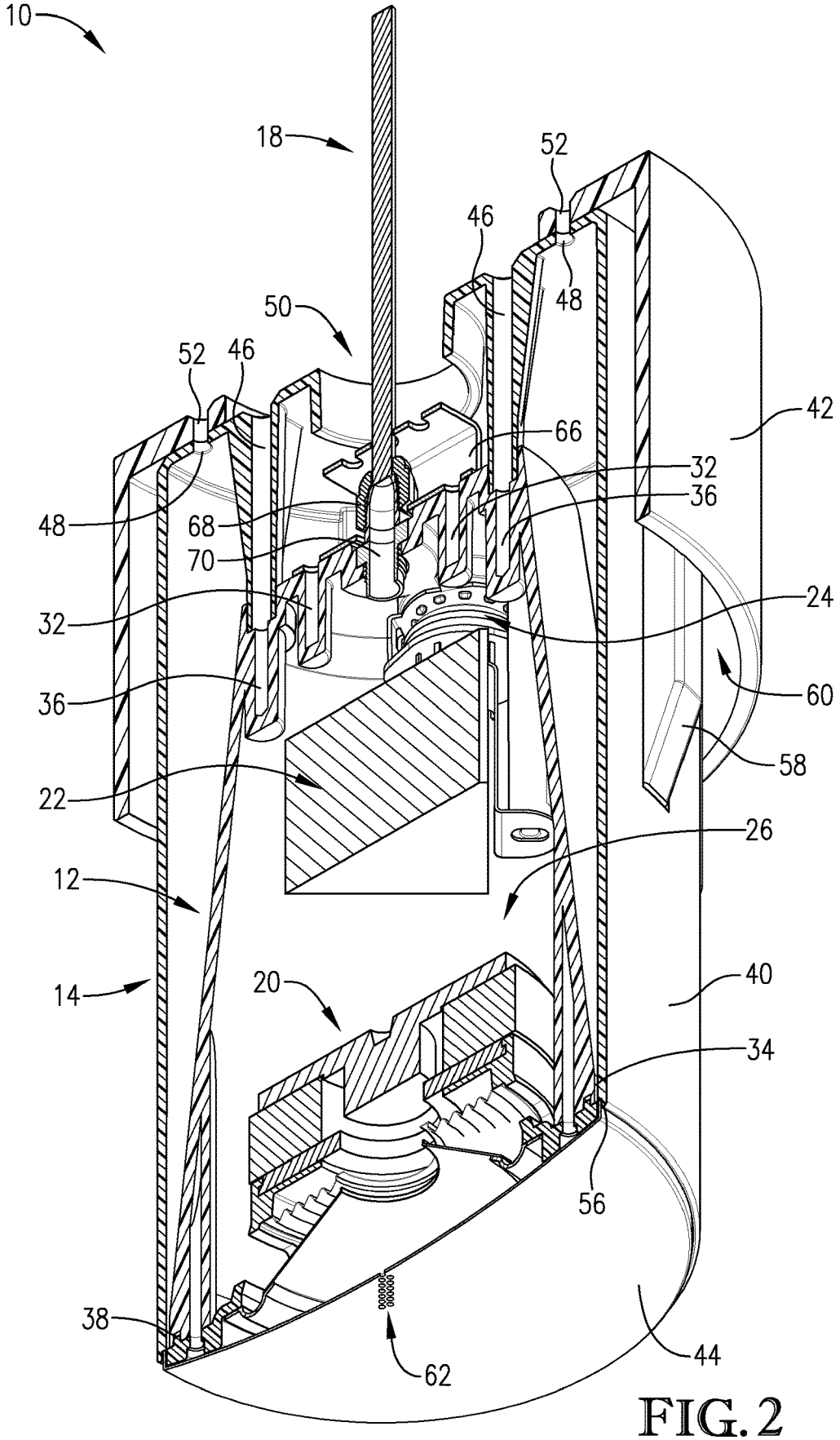
FIG. 2 is a cutaway bottom perspective view of the speaker assembly of FIG. 1.
Figure 3:
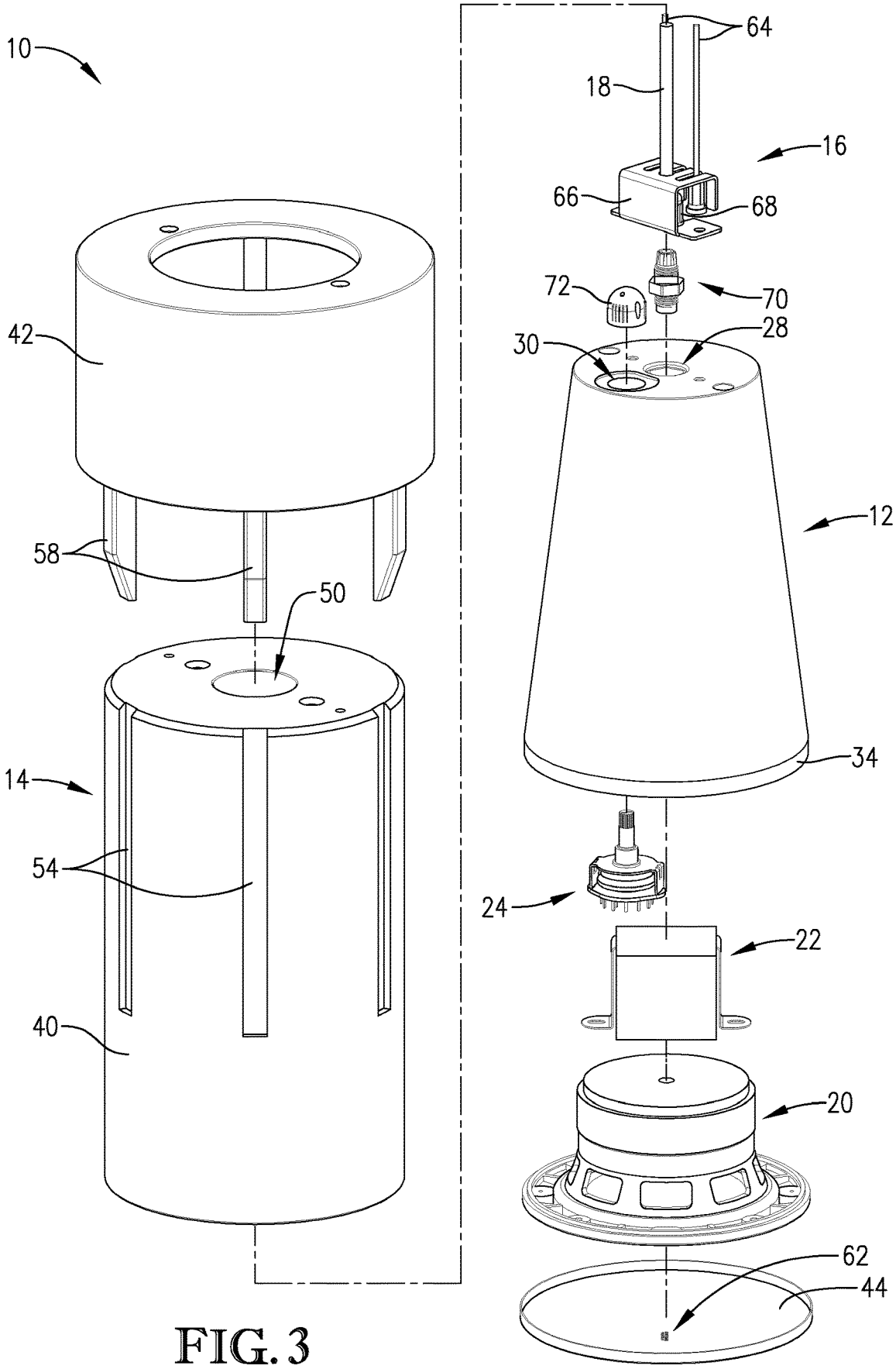
FIG. 3 is an exploded view of the speaker assembly of FIG. 3.

Turning to FIGS. 1-3, a speaker assembly 10 constructed in accordance with an embodiment of the invention is illustrated. The speaker assembly 10 broadly comprises an inner housing 12, an outer shell 14, a hanging assembly 16, a power cord 18, a speaker 20, an input circuit 22, and a control 24.

The inner housing 12 forms a central chamber 26 to protect the speaker 20 and input circuit 22 from the environment and broadly comprises a cord opening 28, a control opening 30, bracket attachment structure 32, a lower press-fit surface 34, outer shell attachment structure 36, and a speaker groove 38. The inner housing 12 may be injection molded, machined, or additively manufactured.

The central chamber 26 retains the speaker 20, the input circuit 22, mounting hardware, and other components. The central chamber 26 may be acoustically shaped for improving audio quality of soundwaves generated by the speaker 20.

The cord opening 28 extends through a top wall of the inner housing 12. The cord opening 28 allows the power cord 18 to pass into the central chamber 26. The cord opening 28 may be positioned near a center axis of the inner housing 12 and may include helical threads, interlocking geometry, friction-fit geometry, or the like for securing a cord anchor (described below) in the cord opening 28.

The control opening 30 extends through the top wall of the inner housing 12 near the cord opening 28. The control opening 30 allows a control knob (described below) to be connected to the control 24 while being positioned outside the inner housing 12.

The bracket attachment structure 32 may be plurality of bolt holes, screw holes, pin holes, or other features for securing the inner housing 12 to a bracket (described below) of the hanging assembly 16. In one embodiment, the bracket attachment structure 32 includes two holes offset on either side of the cord opening 28.

The lower press-fit surface 34 frictionally engages the outer shell 14 to secure the outer shell 14 on the inner housing 12. To that end, the lower press-fit surface 34 may be the outer-most surface of the inner housing 12 and may include small tabs or ridges for facilitating a nested fit between the outer shell 14 and the inner housing 12.

The outer shell attachment structure 36 may be a plurality of countersunk holes, counterbore holes, interlocking geometry, or the like. In one embodiment, the outer shell attachment structure 36 includes two holes offset on either side of the cord opening 28 radially outward from the cord opening 28. The outer shell attachment structure 36 may be configured to align the outer shell 14 with the inner housing 12 in addition to facilitating attachment therebetween.

The speaker groove 38 retains the speaker 20 near a bottom of the inner housing 12. In one embodiment, the speaker groove 38 is a downward-facing annular recess such that the speaker 20 is press-fit (i.e., interference fit) with the inner housing 12 at the bottom of the central chamber 26 and facing downward.

The outer shell 14 encloses the inner housing 12 and broadly comprises a primary enclosure 40, an upper section 42, and a lower cap 44. The outer shell 14 may be cylindrical (as shown in FIGS. 1-3) or may be spherical, conical, frustoconical, bulbous, bell-shaped, flared, or any other suitable shape.

The primary enclosure 40 at least partially encloses the inner housing 12 and includes inner housing attachment structure 46, upper section attachment structure 48, a cord through-hole 50, rib grooves 54, and a lower cap groove 56. The primary enclosure 40 may be cylindrical, spherical, conical, frustoconical, bulbous, bell-shaped, flared, or any other suitable shape.

The inner housing attachment structure 46 may be a plurality of mounting bosses, fastener through-holes, interlocking geometry, or the like for attaching the outer shell 14 to the inner housing 12. In one embodiment, the inner housing attachment structure 46 includes two through-hole mounting bosses configured to align with the outer shell attachment structure 36 of the inner housing 12.

The upper section attachment structure 48 may be a plurality of mounting bosses, fastener through-holes, interlocking geometry, or the like. In one embodiment, the upper section attachment structure 48 includes two fastener through-holes configured to receive fasteners therethrough.

The cord through-hole 50 allows the power cord 18 and supports of the hanging assembly 16 to pass through an upper end of the outer shell 14 to the inner housing 12. The cord through-hole 50 may also provide access to the control knob (described below).

The rib grooves 54 receive ribs (described below) of the upper section 42. The rib grooves 54 may be annularly spaced-apart vertical slots configured to annularly align the ribs (and hence the upper section 42) with the primary enclosure 40.

The lower cap groove 56 may be an annular recess configured to receive an outer edge of the lower cap 44. The lower cap groove 56 may be configured such that the lower cap 44 may be press-fit/interference fit to a bottom of the primary enclosure 40.

The upper section 42 at least partially encircles the primary enclosure 40 and may include lower section attachment structure 52 and ribs 58. The upper section 42 may enhance acoustic quality of soundwaves generated by the speaker 20 and may improve aesthetics of the speaker assembly 10.

The lower section attachment structure 52 may be a plurality of mounting bosses, fastener through-holes, interlocking geometry, or the like. In one embodiment, the lower section attachment structure 52 includes two fastener through-holes configured to receive fasteners therethrough.

The ribs 58 extend vertically downward and are configured to be aligned with the rib grooves 54 of the primary enclosure 40. The ribs 58 provide radial rigidity to the upper section 42 and annularly align the upper section 42 with the primary enclosure 40 via the rib grooves 54.

At least a portion of the upper section 42 is radially spaced from the primary enclosure 40 to create an acoustic channel 60. The ribs 58 divide the acoustic channel 60 into a plurality of discrete sections. The acoustic channel 60 may enhance acoustic quality of soundwaves generated by the speaker 20.

The lower cap 44 encloses the central chamber 26 at a bottom end of the inner housing 12 and may include a plurality of sound openings 62. The lower cap 44 may be press-fit/interference fit to the primary enclosure 40 of the outer shell 14 via the lower cap groove 56.

The plurality of sound openings 62 allow soundwaves generated by the speaker 20 to pass out of the central chamber 26. The plurality of sound openings 62 may be a set of small through-holes or slots. Alternatively, a single sound opening may be used. The plurality of sound openings 62 may also allow moisture to escape the central chamber 26.

The hanging assembly 16 secures the speaker assembly 10 to a ceiling, a structural beam, a wall mount, a shelf, or any other suitable elevated structure. The hanging assembly 16 includes a set of supports 64, a bracket 66, a connector 68, and an anchor 70.

The supports 64 structurally support weight of the speaker assembly 10 and may be rods, cables, chains, tethers, or the like. In one embodiment, two supports 64 are used, which may improve stability of the speaker assembly 10.

The bracket 66 attaches the inner housing 12 to the supports 64. In one embodiment, the bracket 66 is C-shaped (or hooked-tab shaped) and includes geometry for retaining the supports 64 in engagement with the bracket 66 and geometry for securing the bracket 66 to the inner housing 12 via the bracket attachment structure 32.

The connector 68 attaches the power cord 18 to the anchor 70. The connector 68 may be an electronic connector or a passive "screw cap" retainer.

The anchor 70 secures the power cord 18 to the input circuit 22 in the central chamber 26. The anchor 70 may include helical threads or other geometry configured to engage geometry of cord attachment structure near the cord opening 28.

The power cord 18 provides power to the speaker 20 and input circuit 22. The power cord 18 may also include an audio cable for providing audio signals to the speaker 20 and/or the input circuit 22.

The speaker 20 generates soundwaves and may be mounted to a bottom of the inner housing 12. In one embodiment, the speaker 20 faces downward for projecting the soundwaves through the sound openings 62. The speaker 20 may be a woofer, a subwoofer, a bass speaker, a midrange speaker, a tweeter, a full range speaker, or any other suitable speaker.

The input circuit 22 receives audio signals from an external sound system and actively or passively sends the audio signals to the speaker 20. The input circuit 22 may include an antenna, data bus, data port, or any other suitable communication component, an amplifier, a mixer, or any other suitable sound manipulation component.

The control 24 allows a user to set or change a parameter or variable of the speaker 20 or the input circuit 22 and may include a control knob 72. The control 24 may be potentiometer (e.g., for adjusting volume), a relay, a switch, or any other suitable variable electronic component.

The control knob 72 may be positioned outside the inner housing 12 and is connected to the control 24 via the control opening 30. Alternatively, a button, switch, dial, or any other suitable input may be used.

The above-described speaker assembly 10 provides several advantages. For example, the outer shell 14 can be interchanged with other outer shells having different shapes such as cylindrical, spherical, conical, frustoconical, bulbous, bell-shaped, and flared. In this way, it is not necessary to create internal assembly structure for the speaker 20, input circuit 22, and control 24 for different external aesthetics (and acoustic quality). Similarly, new outer shells can be designed without having to also design internal assembly structure. Instead, the new outer shells just need to be compatible with the inner housing 12.

The outer shell 14 may be press-fit/interference fit with the inner housing 12 via the lower press-fit surface 34 of the inner housing 12. The outer shell attachment structure 36 and the inner housing attachment structure 46 further secure the outer shell 14 to the inner housing 12 and annularly aligns the outer shell 14 and the inner housing 12.

The upper section 42 may also improve acoustic quality of the soundwaves generated by the speaker 20. To that end, the acoustic channel 60 between the upper section 42 and the primary enclosure 40 of the outer shell 14 may help focus or direct the soundwaves to a desired listening area.

Figure 4:
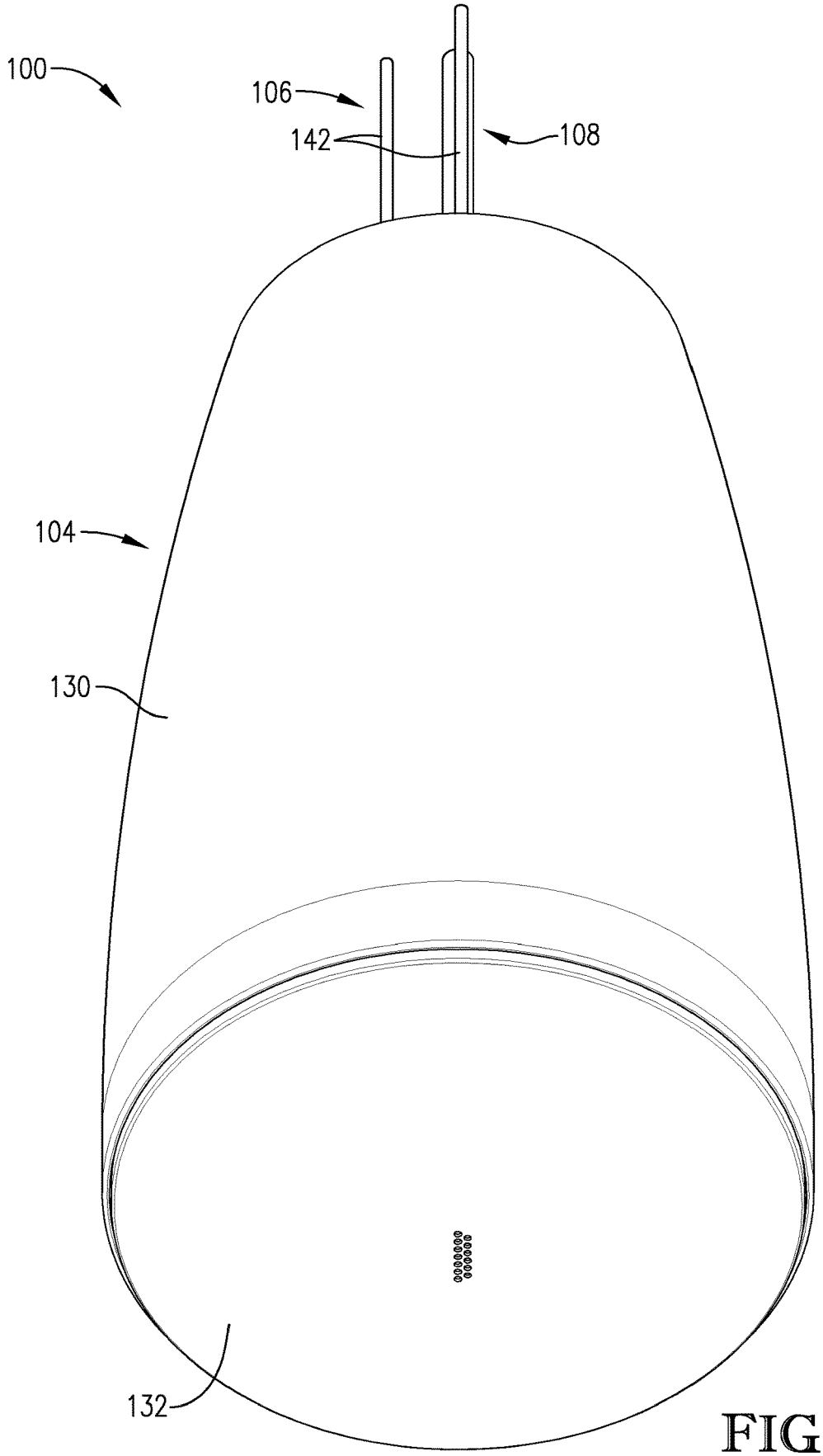
FIG. 4 is a bottom perspective view of a speaker assembly constructed in accordance with another embodiment of the invention.
Figure 5:
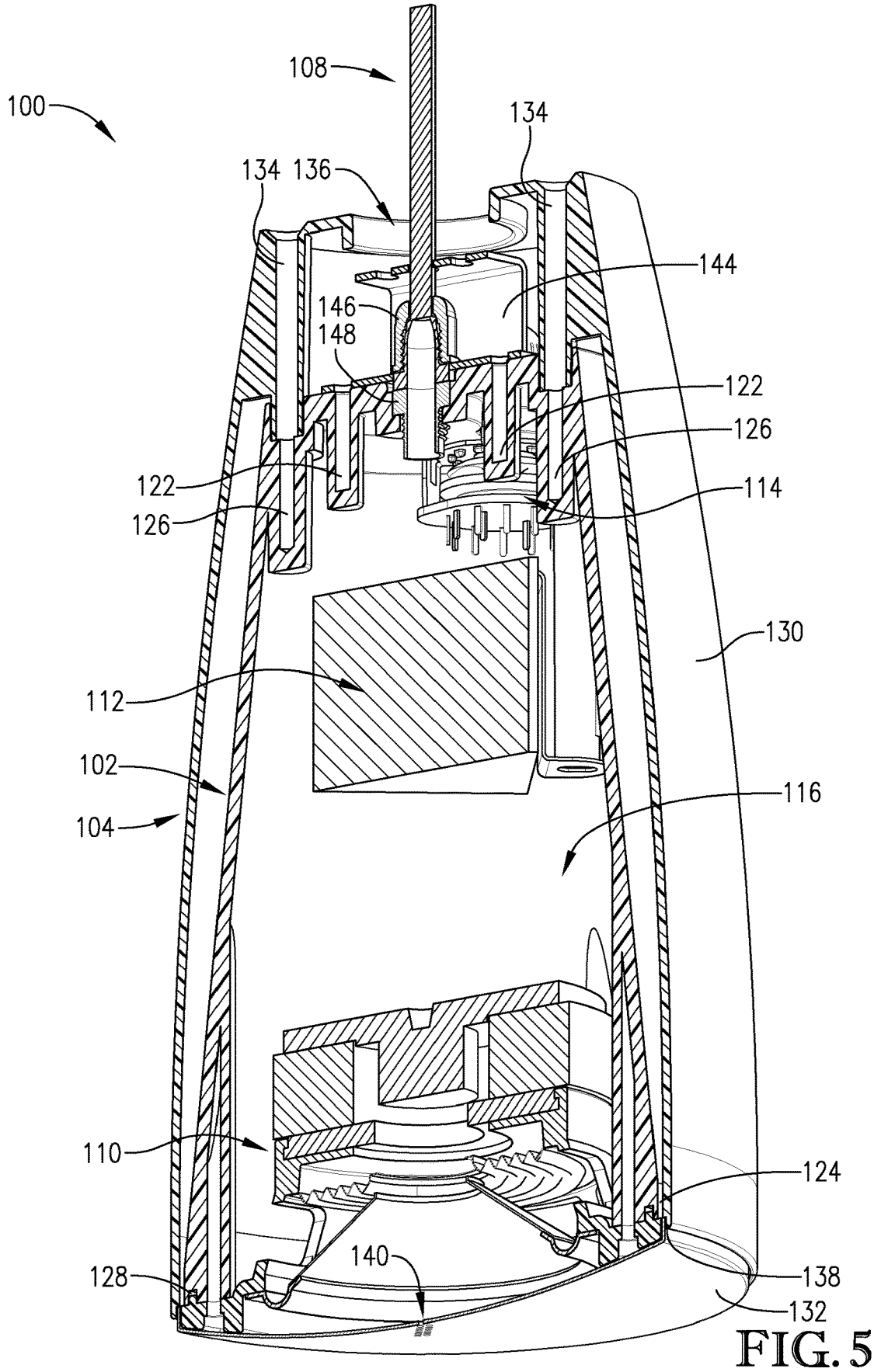
FIG. 5 is a cutaway bottom perspective view of the speaker assembly of FIG. 4.
Figure 6:
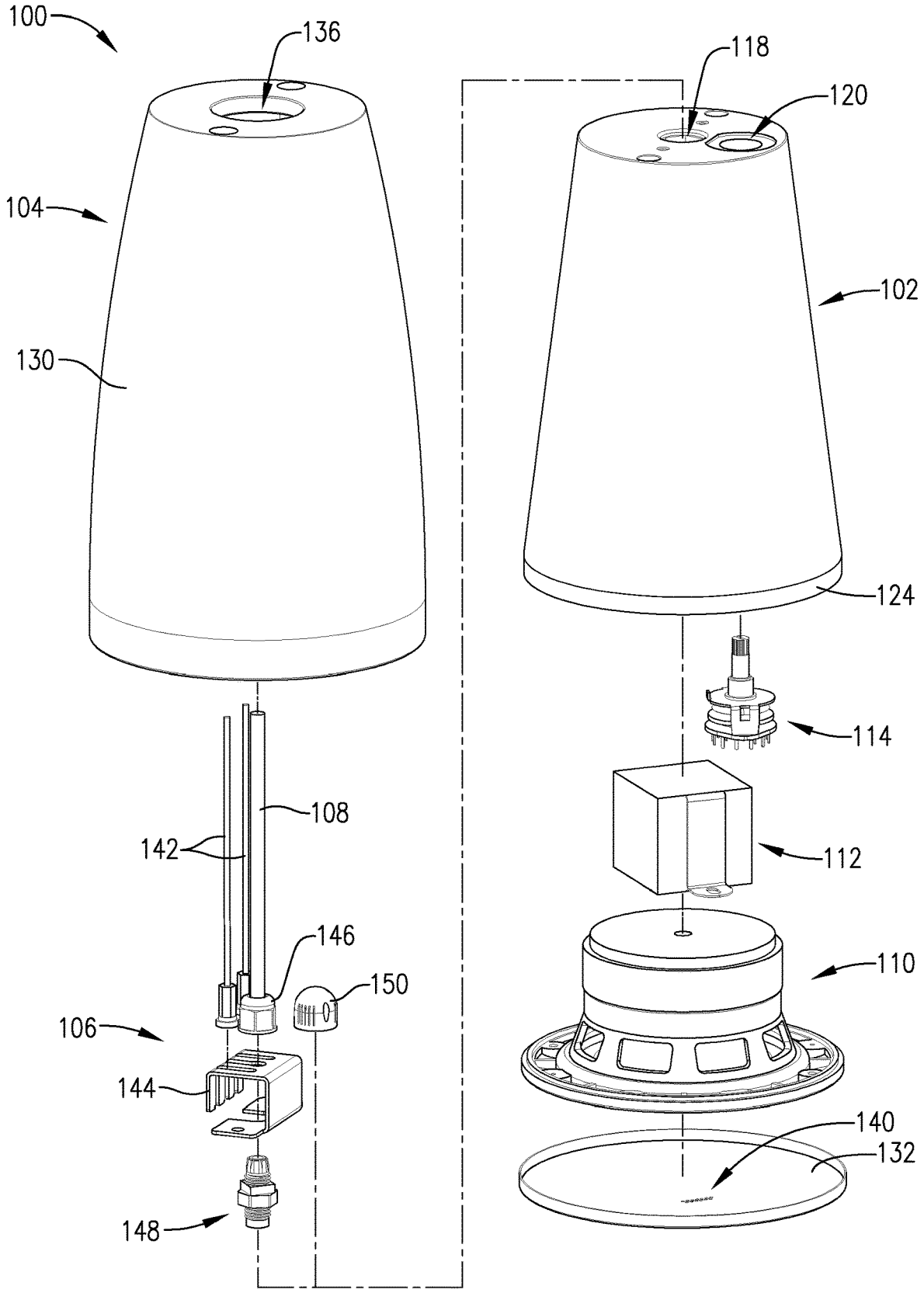
FIG. 6 is an exploded view of the speaker assembly of FIG. 4.

Turning to FIGS. 4-6, a speaker assembly 100 constructed in accordance with another embodiment of the invention is illustrated. The speaker assembly 100 broadly comprises an inner housing 102, an outer shell 104, a hanging assembly 106, a power cord 108, a speaker 110, an input circuit 112, and a control 114.

The inner housing 102 forms a central chamber 116 to protect the speaker 110 and input circuit 112 from the environment and broadly comprises a cord opening 118, a control opening 120, bracket attachment structure 122, a lower press-fit surface 124, outer shell attachment structure 126, and a speaker groove 128. The inner housing 102 may be injection molded, machined, or additively manufactured.

The central chamber 116 retains the speaker 110, the input circuit 112, mounting hardware, and other components. The central chamber 116 may be acoustically shaped for improving audio quality of soundwaves generated by the speaker 110.

The cord opening 118 extends through a top wall of the inner housing 102. The cord opening 118 allows the power cord 108 to pass into the central chamber 116. The cord opening 118 may be positioned near a center axis of the inner housing 102.

The control opening 120 extends through the top wall of the inner housing 102 near the cord opening 118. The control opening 120 allows a control knob (described below) to be connected to the control 114 while being positioned outside the inner housing 102.

The bracket attachment structure 122 may be plurality of bolt holes, screw holes, pin holes, or other features for securing the inner housing 102 to a bracket (described below) of the hanging assembly 106. In one embodiment, the bracket attachment structure 122 includes two holes offset on either side of the cord opening 118.

The lower press-fit surface 124 frictionally engages the outer shell 104 to secure the outer shell 104 on the inner housing 102. To that end, the lower press-fit surface 124 may be the outer-most surface of the inner housing 102 and may include small tabs or ridges for facilitating a nested fit between the outer shell 104 and the inner housing 12.

The outer shell attachment structure 126 may be a plurality of countersunk holes, counterbore holes, interlocking geometry, or the like. In one embodiment, the outer shell attachment structure 126 includes two holes offset on either side of the cord opening 118 radially outward from the cord opening 118. The outer shell attachment structure 126 may be configured to align the outer shell 104 with the inner housing 102 in addition to facilitating attachment therebetween.

The speaker groove 128 retains the speaker 110 near a bottom of the inner housing 102. In one embodiment, the speaker groove 128 is a downward-facing annular recess such that the speaker 110 is press-fit (i.e., interference fit) with the inner housing 102 at the bottom of the central chamber 116 and facing downward.

The outer shell 104 encloses the inner housing 102 and broadly comprises a primary enclosure 130 and a lower cap 132. The outer shell 104 may have a concave tapered cylinder shape, as shown in FIGS. 4-6. Alternatively, the outer shell 104 may be cylindrical, spherical, conical, frustoconical, bulbous, bell-shaped, flared, or any other suitable shape.

The primary enclosure 130 at least partially encloses the inner housing 102 and includes inner housing attachment structure 134, a cord through-hole 136, and a lower cap groove 138. The primary enclosure 130 may have a concave tapered cylinder shape, as shown in FIGS. 4-6. Alternatively, the primary enclosure 130 may be cylindrical, spherical, conical, frustoconical, bulbous, bell-shaped, flared, or any other suitable shape.

The inner housing attachment structure 134 may be a plurality of mounting bosses, fastener through-holes, interlocking geometry, or the like for attaching the outer shell 104 to the inner housing 102. In one embodiment, the inner housing attachment structure 134 includes two through-hole mounting bosses configured to align with the outer shell attachment structure 126 of the inner housing 102.

The cord through-hole 136 allows the power cord 108 and supports of the hanging assembly 106 to pass through an upper end of the outer shell 104 to the inner housing 102. The cord through-hole 136 may also provide access to the control knob (described below).

The lower cap groove 138 may be an annular recess configured to receive an outer edge of the lower cap 132. The lower cap groove 138 may be configured such that the lower cap 132 may be press-fit/interference fit to a bottom of the primary enclosure 130.

The lower cap 132 encloses the central chamber 116 at a bottom end of the inner housing 102 and may include a plurality of sound openings 140. The lower cap 132 may be press-fit/interference fit to the primary enclosure 130 of the outer shell 104 via the lower cap groove 138.

The plurality of sound openings 140 allow soundwaves generated by the speaker 110 to pass out of the central chamber 116. The plurality of sound openings 140 may be a set of small through-holes or slots. Alternatively, a single sound opening may be used. The plurality of sound openings 140 may also allow moisture to escape the central chamber 116.

The hanging assembly 106 secures the speaker assembly 100 to a ceiling, a structural beam, a wall mount, a shelf, or any other suitable elevated structure. The hanging assembly 106 includes a set of supports 142, a bracket 144, a connector 146, and an anchor 148.

The supports 142 structurally support weight of the speaker assembly 100 and may be rods, cables, chains, tethers, or the like. In one embodiment, two supports 142 are used, which may improve stability of the speaker assembly 100.

The bracket 144 attaches the inner housing 102 to the supports 142. In one embodiment, the bracket 144 is C-shaped (or hooked-tab shaped) and includes geometry for retaining the supports 142 in engagement with the bracket 144 and geometry for securing the bracket 144 to the inner housing 102 via the bracket attachment structure 122.

The connector 146 attaches the power cord 108 to the anchor 148. The connector 146 may be an electronic connector or a passive "screw cap" retainer.

The anchor 148 secures the power cord 108 to the input circuit 112 in the central chamber 116. The anchor 148 may include helical threads or other geometry configured to engage geometry of cord attachment structure near the cord opening 118.

The power cord 108 provides power to the speaker 110 and input circuit 112. The power cord 108 may also include an audio cable for providing audio signals to the speaker 110 and/or the input circuit 112.

The speaker 110 generates soundwaves and may be mounted to a bottom of the inner housing 102. In one embodiment, the speaker 110 faces downward for projecting the soundwaves through the sound openings 140. The speaker 110 may be a woofer, a subwoofer, a bass speaker, a midrange speaker, a tweeter, a full range speaker, or any other suitable speaker.

The input circuit 112 receives audio signals from an external sound system and actively or passively sends the audio signals to the speaker 110. The input circuit 112 may include an antenna, data bus, data port, or any other suitable communication component, an amplifier, a mixer, or any other suitable sound manipulation component.

The control 114 allows a user to set or change a parameter or variable of the speaker 110 or the input circuit 112 and may include a control knob 150. The control 114 may be potentiometer (e.g., for adjusting volume), a relay, a switch, or any other suitable variable electronic component.

The control knob 150 may be positioned outside the inner housing 102 and is connected to the control 114 via the control opening 120. Alternatively, a button, switch, dial, or any other suitable input may be used.

The above-described speaker assembly 100 provides several advantages. For example, the outer shell 104 can be interchanged with other outer shells having different shapes such as cylindrical, spherical, conical, frustoconical, bulbous, bell-shaped, and flared. In this way, it is not necessary to create internal assembly structure for the speaker 110, input circuit 112, and control 114 for different external aesthetics (and acoustic quality). Similarly, new outer shells can be designed without having to also design internal assembly structure. Instead, the new outer shells just need to be compatible with the inner housing 102.

The outer shell 104 may be press-fit/interference fit with the inner housing 102 via the lower press-fit surface 124 of the inner housing 102. The outer shell attachment structure 126 and the inner housing attachment structure 134 further secure the outer shell 104 to the inner housing 102 and annularly aligns the outer shell 104 and the inner housing 102.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A speaker assembly comprising:

an inner housing forming a central chamber, the inner housing including outer shell attachment structure;

an outer shell including:

a primary enclosure at least partially enclosing the inner housing, the primary enclosure including inner housing attachment structure for securing the outer shell to the inner housing via the outer shell attachment structure of the inner housing;

an upper section engaging the primary enclosure and including a plurality of ribs, at least a portion of the upper section being spaced from the primary enclosure to form an acoustic channel between the primary enclosure and the upper section, the plurality of ribs dividing the acoustic channel; and a lower cap configured to be attached to the primary enclosure, the lower cap including a sound opening and at least partially enclosing the central chamber of the inner housing;

an input circuit for receiving audio signals from an audio source; and a speaker positioned in the central chamber of the inner housing and coupled with the input circuit for generating soundwaves and projecting the soundwaves through the sound opening of the lower cap, the primary enclosure being at least partially press-fit onto the inner housing, the outer shell being interchangeable other outer shells having different shapes than the outer shell of the speaker assembly.

2. The speaker assembly of claim 1, the outer shell attachment structure and the inner housing attachment structure being configured to annularly align the outer shell on the inner housing.

3. The speaker assembly of claim 1, further comprising a power cord configured to be connected to the input circuit, the inner housing further including power cord attachment structure for securing at least a portion of the power cord in the central chamber of the inner housing.

4. The speaker assembly of claim 1, the primary enclosure including a plurality of rib grooves, the plurality of ribs being configured to be positioned in the rib grooves to annularly align the upper section with the primary enclosure.

5. The speaker assembly of claim 1, further comprising a hanging assembly, the inner housing further including anchor attachment structure for securing the inner housing to the hanging assembly.

6. The speaker assembly of claim 5, the primary enclosure including an upper opening, the hanging assembly including an anchor bracket configured to be attached to the inner housing and a support configured to extend through the upper opening, the anchor bracket being configured to be connected to the support below the upper opening of the primary enclosure.

7. The speaker assembly of claim 1, the inner housing being frustoconical.

8. The speaker assembly of claim 1, the primary enclosure having a lower cap groove, the lower cap being configured to engage the lower cap groove.

9. The speaker assembly of claim 1, the primary enclosure being cylindrical.

10. The speaker assembly of claim 1, the upper section being cylindrical.

11. A speaker assembly comprising:

an inner housing forming a central chamber, the inner housing including outer shell attachment structure and anchor attachment structure;

an outer shell including:

a primary enclosure at least partially enclosing the inner housing, the primary enclosure including inner housing attachment structure for securing the outer shell to the inner housing via the outer shell attachment structure of the inner housing; and a lower cap configured to be attached to the primary enclosure, the lower cap including a sound opening and at least partially enclosing the central chamber of the inner housing;

an input circuit for receiving audio signals from an audio source;

a speaker positioned in the central chamber of the inner housing and coupled with the input circuit for generating soundwaves and projecting the soundwaves through the sound opening of the lower cap, the primary enclosure being at least partially press-fit onto the inner housing, the outer shell being interchangeable with other outer shells having different shapes than the outer shell of the speaker assembly; and a hanging assembly configured to be connected to the anchor attachment structure of the inner housing for suspending the inner housing from the hanging assembly.

12. The speaker assembly of claim 11, the outer shell attachment structure and the inner housing attachment structure being configured to annularly align the outer shell on the inner housing.

13. The speaker assembly of claim 11, further comprising a power cord configured to be connected to the input circuit, the inner housing further including power cord attachment structure for securing at least a portion of the power cord in the central chamber of the inner housing.

14. The speaker assembly of claim 11, the primary enclosure having a tapered shape.

15. The speaker assembly of claim 11, the primary enclosure including an upper opening, the hanging assembly including an anchor bracket configured to be attached to the inner housing via the anchor attachment structure and a support configured to extend through the upper opening, the anchor bracket being configured to be connected to the support below the upper opening of the primary enclosure.

16. The speaker assembly of claim 11, the inner housing being frustoconical.

17. The speaker assembly of claim 11, the primary enclosure having a lower cap groove, the lower cap being configured to engage the lower cap groove.

18. A speaker assembly comprising:

an inner housing forming a central chamber, the inner housing including outer shell attachment structure, anchor attachment structure, and a press-fit surface;

a plurality of interchangeable outer shells, each outer shell including:

a primary enclosure at least partially enclosing the inner housing, the primary enclosure including inner housing attachment structure for securing the outer shell to the inner housing via the outer shell attachment structure of the inner housing, the primary enclosure being configured to be press-fit against the press-fit surface of the inner housing; and a lower cap configured to be attached to the primary enclosure, the lower cap including a plurality of sound openings and at least partially enclosing the central chamber of the inner housing, the outer shells having different outer shapes and being interchangeable with each other on the inner housing;

an input circuit for receiving audio signals from an audio source;

a speaker facing downward near a bottom of the central chamber of the inner housing and coupled with the input circuit for generating soundwaves and projecting the soundwaves downward through the sound opening of the lower cap; and a hanging assembly configured to be connected to the anchor attachment structure of the inner housing for suspending the inner housing from the hanging assembly.

* * * * *